US007201020B2

(12) United States Patent
Frank

(10) Patent No.: US 7,201,020 B2
(45) Date of Patent: Apr. 10, 2007

(54) WATCH BAND WITH COVER MEMBER

(75) Inventor: Philip Andrew Frank, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/125,622

(22) Filed: May 9, 2005

(65) Prior Publication Data

US 2005/0193767 A1 Sep. 8, 2005

Related U.S. Application Data

(62) Division of application No. 10/685,309, filed on Oct. 14, 2003, now Pat. No. 7,107,790.

(51) Int. Cl.
*A44C 5/00* (2006.01)
*G04B 37/14* (2006.01)

(52) U.S. Cl. ..... 63/9; 224/164; 224/167; 224/180; D10/32; 368/288; 368/286; 368/283

(58) Field of Classification Search ..... 63/3, 63/21, 9, 11, 21.1, 14; 224/178, 164, 167, 224/168, 174, 180; 368/283, 286, 287, 288, 368/309; D10/32; 911/94
See application file for complete search history.

(56) References Cited

U.S. PATENT DOCUMENTS

| | | | | | |
|---|---|---|---|---|---|
| 2,120,348 | A | | 6/1938 | Bezault | |
| D111,613 | S | * | 10/1938 | Pohli | D10/33 |
| 2,303,294 | A | | 11/1942 | Wagner | |
| 2,565,822 | A | * | 8/1951 | McClelland | 368/286 |
| 2,636,338 | A | * | 4/1953 | Dinstman | 368/283 |
| 2,692,070 | A | * | 10/1954 | Kammer | 368/286 |
| 2,787,893 | A | | 4/1957 | Canning | |
| 3,365,877 | A | * | 1/1968 | Altman | 368/285 |
| 3,965,670 | A | | 6/1976 | Ihringer | |
| 4,178,751 | A | * | 12/1979 | Liautaud | 368/281 |
| 4,593,842 | A | | 6/1986 | Koenuma | |
| 4,627,739 | A | | 12/1986 | Shingo et al. | |
| 4,821,532 | A | | 4/1989 | Jaques et al. | |
| 4,825,427 | A | | 4/1989 | Wollman et al. | |
| 4,916,679 | A | * | 4/1990 | Agnello | 368/283 |
| D316,050 | S | * | 4/1991 | Weil | D10/32 |
| D319,790 | S | | 9/1991 | Burgener | |
| 5,331,610 | A | | 7/1994 | Kikuchi | |
| D392,584 | S | * | 3/1998 | Hysek | D11/22 |

(Continued)

FOREIGN PATENT DOCUMENTS

| | | |
|---|---|---|
| CH | 664475 | 10/1985 |

(Continued)

*Primary Examiner*—Katherine Mitchell
(74) *Attorney, Agent, or Firm*—Banner & Witcoff, Ltd.

(57) ABSTRACT

A band that may be utilized for a timepiece, such as a watch, is disclosed. The band may have a plurality of joined links, and each link includes a cover member, an extension element, a first springbar, and a second springbar. The extension element defines a first channel and a second channel, the first springbar extends through the first channel to secure the extension element to the cover member, and the second springbar extends through the second channel to join the extension element to an adjacent cover member. In addition, the cover member is configured to join with an adjacent extension element that is separate from the extension element.

18 Claims, 8 Drawing Sheets

U.S. PATENT DOCUMENTS

| | | | | |
|---|---|---|---|---|
| D415,039 | S * | 10/1999 | Strasser | D10/30 |
| 6,053,630 | A | 4/2000 | Polansky et al. | |
| 6,101,842 | A | 8/2000 | Delacretaz et al. | |
| D432,436 | S | 10/2000 | Baumann | |
| 6,191,842 | B1 | 2/2001 | Navarro | |
| 6,739,748 | B2 * | 5/2004 | Della Santa | 368/283 |
| 2002/0009019 | A1 | 1/2002 | Gunster et al. | |
| 2003/0121280 | A1 | 7/2003 | So et al. | |

FOREIGN PATENT DOCUMENTS

| | | |
|---|---|---|
| CH | 663136 | 11/1987 |
| CH | 675669 | 10/1990 |
| EP | 0081464 | 12/1982 |
| EP | 1048240 | 11/2000 |
| JP | 3-224501 | 3/1991 |

* cited by examiner

WATCH BAND WITH COVER MEMBER

CROSS-REFERENCE TO RELATED APPLICATION

This non-provisional U.S. patent application is a divisional application of and claims priority to U.S. patent application Ser. No. 10/685,309, which was filed in the U.S. Patent and Trademark Office on Oct. 14, 2003 now U.S. Pat. No. 7,107,790 and entitled Flexible Band, such prior U.S. patent application being entirely incorporated herein by reference.

BACKGROUND OF THE INVENTION

1. Field of the Invention

The present invention relates to bands for articles such as wrist-worn timepieces or jewelry, for example. The invention concerns, more particularly, a band with at least one cover member.

2. Description of Background Art

A conventional wrist-worn timepiece, typically referred to as a watch, may be designed to perform both aesthetically and functionally during a variety of activities. Dress watches, for example, are designed to have a fashionable appearance that is appropriate for business or social gatherings. Diving watches are designed to be particularly durable and to withstand the high-pressure environments often encountered by deep-sea divers. Similarly, athletic watches exhibit a lightweight, durable structure suitable for being worn by athletes participating in training exercises or various competitions where the features of a watch may be beneficial.

The components of a conventional watch typically include a timing element, a case, and a band. The timing element is located within the case and functions to track the time and display the time for a wearer or another individual. The timing element may also perform a variety of other functions, such as recording chronographic data, providing an alarm, displaying the date, monitoring the heart rate of the wearer, calculating distance traveled, functioning as a calculator, providing audible signals to pace the running speed of the wearer, gauging the temperature of surrounding air, displaying altitude, or functioning as a global positioning system, for example. The case protects the timing element and often includes a transparent face for viewing a time display on the timing element. The band extends from opposite sides of the case and secures the case and timing element to a wrist of a wearer.

Although the majority of watches include a timing element, a case, and a band, modem watch designs include a plurality of variations upon the components. The timing element, for example, may be mechanical, electrical, or a combination of mechanical and electrical. The band may incorporate a clasp that secures the watch to the wrist, or the band may exhibit an open, bracelet-like configuration. Furthermore, the materials that form the various components may include both polymers and metals, for example.

SUMMARY OF THE INVENTION

The present invention is band that may be utilized for a timepiece, such as a watch, for example. The band has a plurality of joined links, and each link includes a cover member, an extension element, a first springbar, and a second springbar. The extension element defines a first channel and a second channel, the first springbar extends through the first channel to secure the extension element to the cover member, and the second springbar extends through the second channel to join the extension element to an adjacent cover member. In addition, the cover member is configured to join with an adjacent extension element that is separate from the extension element.

The cover member may include a first pair of apertures that receive end portions of the first springbar to secure the extension element to the cover member. In addition, the cover member may include a second pair of apertures that receive end portions of an adjacent springbar to join the adjacent extension element to the cover member. The apertures may be formed in sidewalls of the cover member. Various materials are suitable for the components of the band. For example, the cover member may be formed of a metal material, and the extension element may be formed of a flexible polymer material, such as urethane.

In another aspect of the invention, a wrist-worn timepiece includes a case, a timing element, a crystal, and a band. The case defines a recess, and the timing element is positioned within the recess. The crystal extends over the timing element and is formed of an at least partially transparent material. The band extends from at least one side of the case, and the band has a plurality of links joined by springbars. In addition, the band includes a cover member extending over at least a portion of the crystal.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
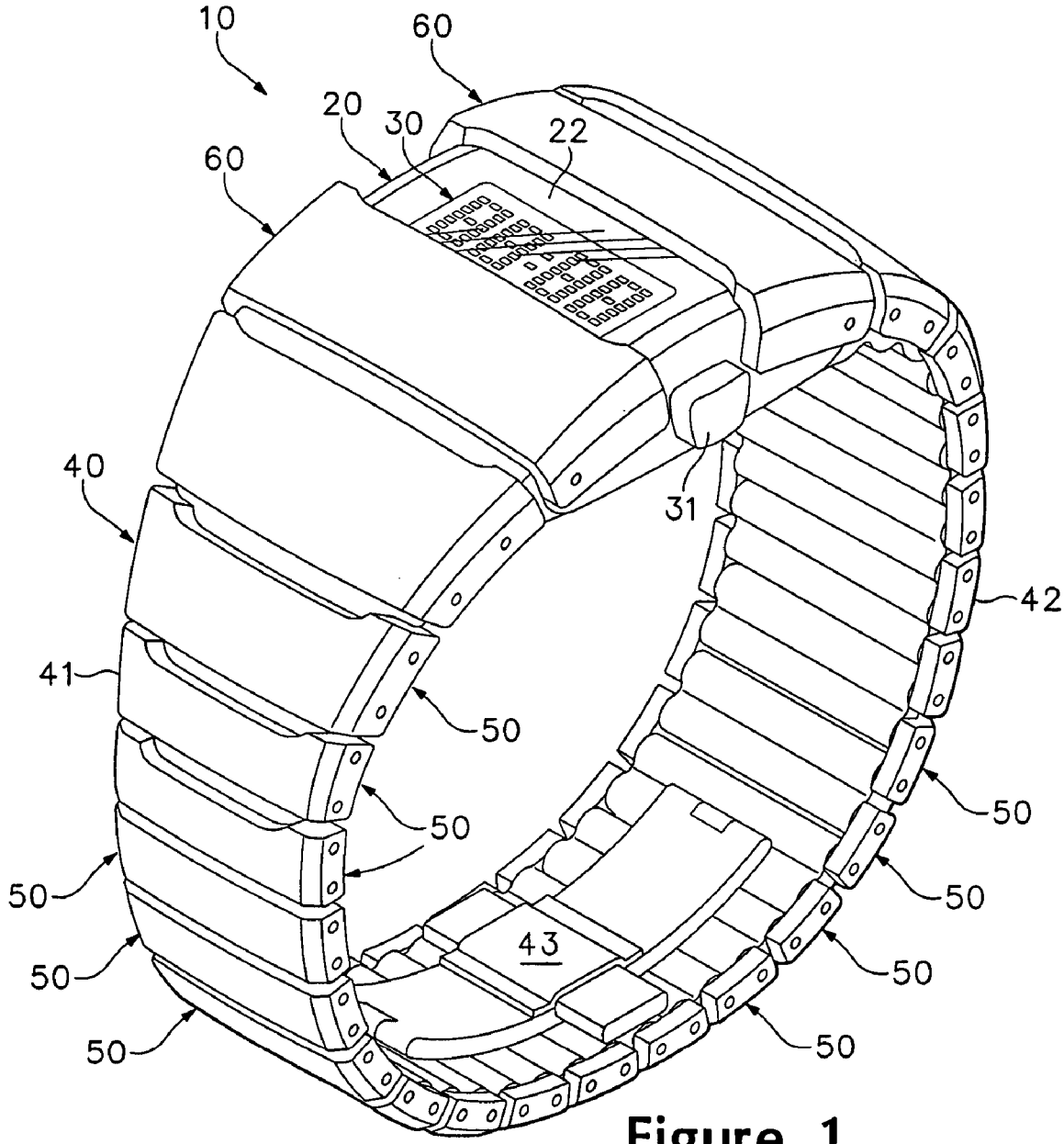
FIG. 1 is a perspective view of a wrist-worn timepiece having a band in accordance with the present invention.

The following discussion and accompanying figures disclose a timepiece 10 in accordance with the present invention. Timepiece 10 is depicted in FIGS. 1–4 and includes a case 20, a timing element 30, and a band 40. The various components of timepiece 10 are configured such that timing element 30 is positioned within case 20, and band 40 extends from opposite sides of case 20. In operation, band 40 extends around a wrist of a wearer, thereby securing timepiece 10 to the wrist. Timepiece 10, as depicted in the figures, exhibits a sport watch configuration that is suitable for athletic activities. One skilled in the relevant art will recognize, however, that the concepts disclosed below with respect to timepiece 10 may be applied to a wide range of timepiece styles and functions, in addition to the style and function of a sport watch.

Case 20 may be formed to have any practical shape ranging from round to angular. The primary purposes of case 20 are to receive timing element 30 and provide timing element 30 with an aesthetically-appealing, protective housing. Accordingly, case 20 includes a recess 21 configured to receive timing element 30. In order to further protect timing element 30, case 20 or timing element 30 may include a transparent crystal 22 that permits the wearer and other individuals to view the time or other information displayed by timing element 30. Crystal 22 may be formed from a plurality of materials that are at least partially transparent, including sapphire crystal, glass, or polymer materials, for example. Accordingly, the material forming crystal 22 may be a plurality of materials, in addition to a crystal material. Case 20 also includes four projections 23 that each define an aperture 24. Although one skilled in the relevant art will recognize that any attachment method is intended to fall within the scope of the present invention, projections 23 and apertures 24 provide suitable attachment points for securing band 40 to case 20.

The primary purpose of timing element 30 is to track and display time. Timing element 30 is depicted as having a digital display, but may also display time in an analog manner or in both a digital and an analog manner. By depressing or otherwise activating buttons 31 that extend through case 20, timing element 30 may also perform one or more alternate functions in addition to tracking and displaying time. The alternate functions may include, for example, performing as a chronograph, providing an alarm, displaying the date, monitoring the heart rate of the wearer, calculating distance traveled, functioning as a calculator, providing audible signals to pace the running speed of the wearer, gauging the temperature of surrounding air, displaying altitude, or functioning as a global positioning system.

Band 40 includes a first band portion 41 and a second band portion 42 that are formed from a plurality of links 50. In addition, first band portion 41 and second band portion 42 each include a connector link 60 that joins with projections 23 to secure band 40 to case 20. Accordingly, first band portion 41 extends from a front area of case 20, and second band portion 42 extends from an opposite rear area of case 20. Ends of first band portion 41 and second band portion 42 that are positioned opposite connector link 60 may be joined together with a clasp 43, which may have any conventional structure suitable for securing timepiece 10 to the wrist.

An individual link 50 is depicted in FIGS. 5–8 and includes a cover member 51, an extension element 52, a first springbar 53*a*, and a second springbar 53*b*. Cover member 51 forms an exterior of band 40 and includes a pair of end portions 54 that form sidewalls of cover member 51 and extend along sides of extension element 52. In addition, each end portion 54 defines an aperture 55*a* and an aperture 55*b* such that each cover member 51 includes a pair of apertures 55*a* and a pair of apertures 55*b*. Cover member 51 may provide protection and limit the degree of wear in extension element 52, first springbar 53*a*, and second springbar 53*b*. Accordingly, cover member 51 may be formed from a durable, wear-resistant material, such as a polymer or metal, for example. Suitable metals include steel, stainless steel, aluminum, and titanium.

Extension element 52 includes a first surface 56*a*, a second surface 56*b*, and a pair of substantially parallel channels 57*a* and 57*b*. First surface 56*a* is positioned opposite second surface 56*b* and is depicted as having a generally planar configuration. Second surface 56*b* includes an indentation or other contour between channels 57*a* and 57*b* but may also exhibit a generally planar configuration that is similar to first surface 56*a*. Similarly, first surface 56*a* may incorporate a contour. Channels 57*a* and 57*b* have a generally circular shape and extend through extension element 52. Suitable materials for extension element 52 include both polymers and metals. As will be apparent from the following discussion, however, the overall flexibility of band 40 is enhanced when extension element 53 is formed from a flexible material, such as urethane.

First springbar 53*a* and second springbar 53*b* have a substantially identical configuration that includes a tube 58, a pair of depressible ends 59, and a spring (not depicted). Ends 59 project outward from tube 58 and are positioned on opposite sides of the spring, which is located within tube 58. In operation, one or both of ends 59 may be depressed so as to retreat within tube 58. Accordingly, springbars 53*a* and 53*b* have a configuration that is substantially similar to the springbars that are conventionally utilized to secure a watch band to a watch case.

Figure 5:
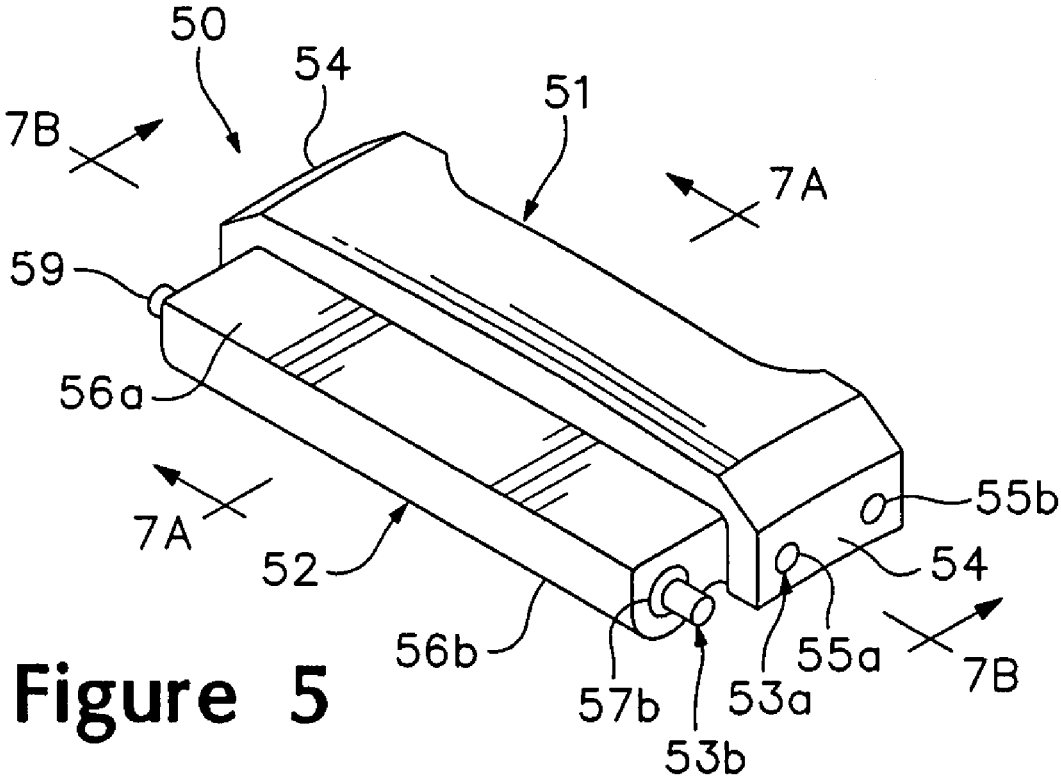
FIG. 5 is a first perspective view of a link portion of the band.
Figure 6:
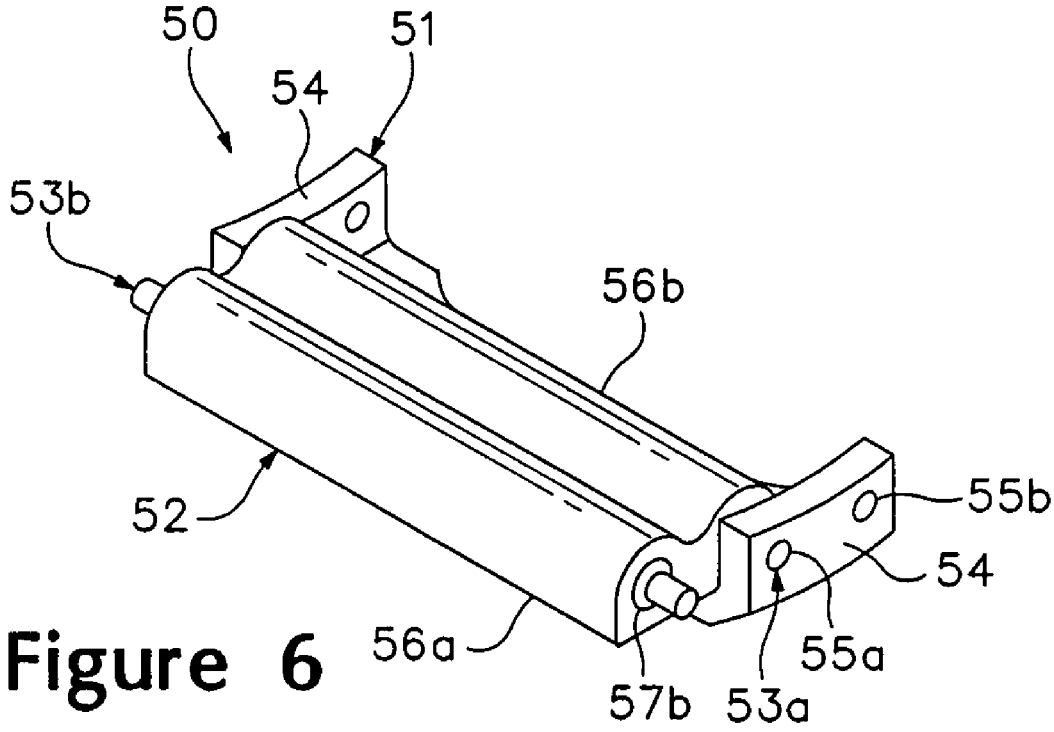
FIG. 6 is a second perspective view of the link portion.
Figure 7A:
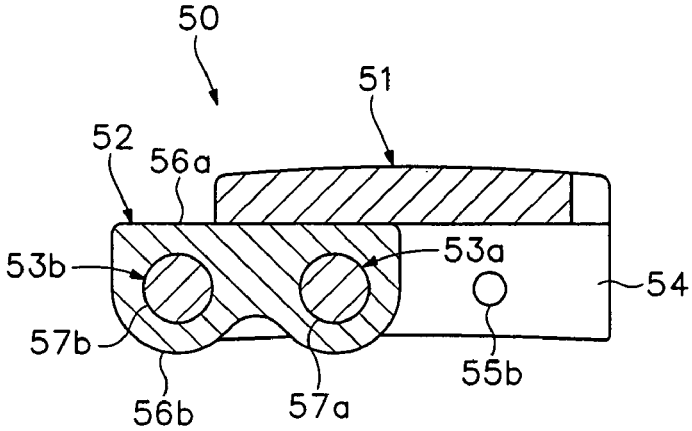
FIG. 7A is a first cross-sectional view of the link portion, as defined by section line 7A—7A in FIG. 5.
Figure 7B:
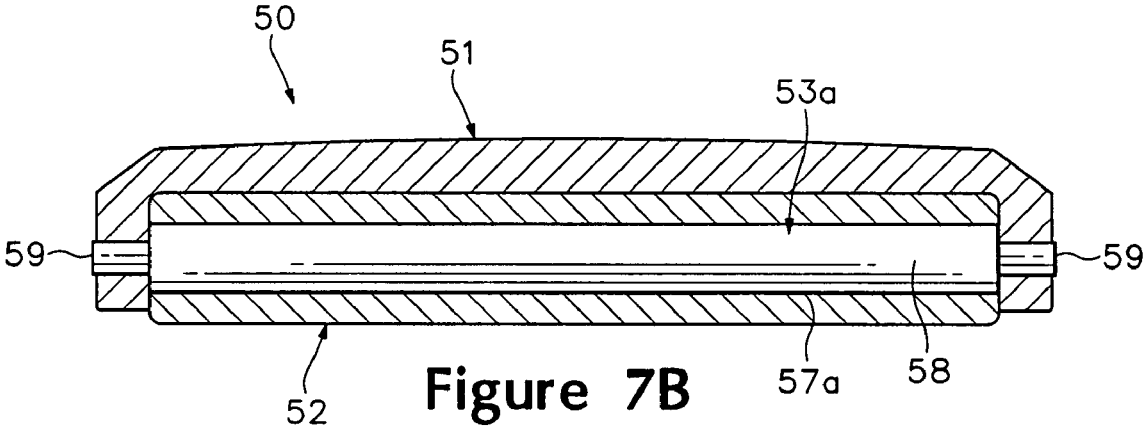
FIG. 7B is a second cross-sectional view of the link portion, as defined by section line 7B—7B in FIG. 5.
Figure 8:
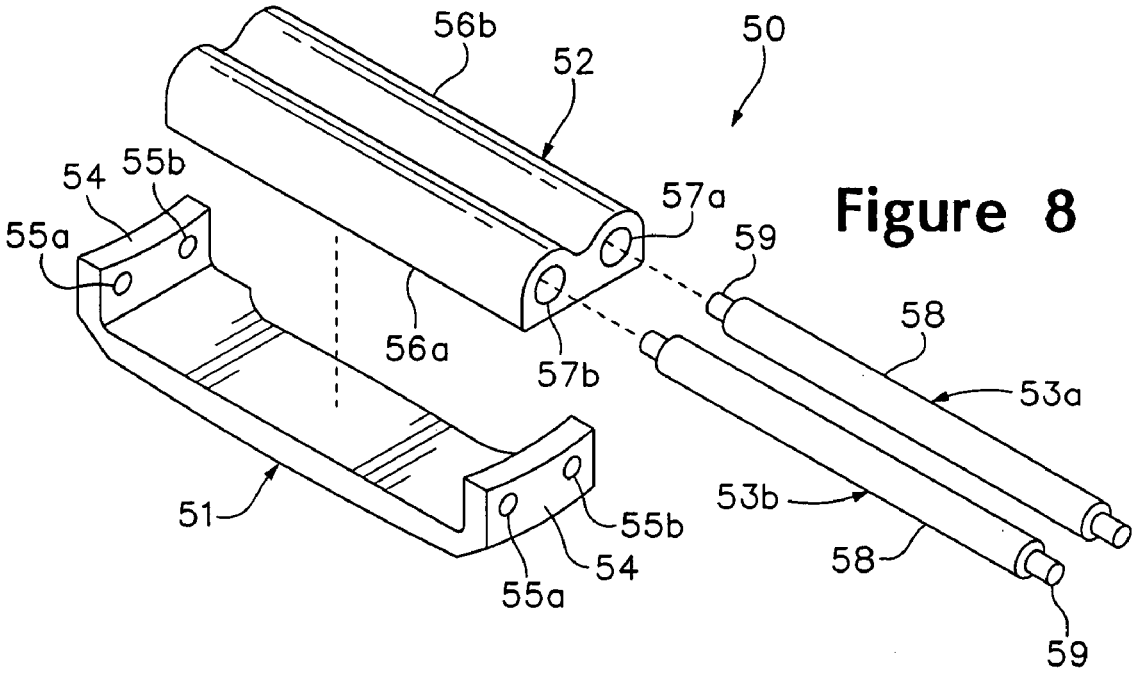
FIG. 8 is an exploded perspective view of the link portion.

Each link 50 is assembled such that extension element 52 is positioned between end portions 54 of cover member 51, as depicted in FIGS. 5 and 6. The portion of extension element 52 that includes channel 57*b* extends outward from cover member 51 such that channel 57*a* is aligned with apertures 55*a*. In this configuration, first springbar 53*a* extends through channel 57*a* such that tube 58 contacts the interior surface of channel 57*a* and ends 59 extend into apertures 55*a*. In this configuration, cover member 51 and extension element 52 are secured together with first springbar 53*a*, first surface 56*a* contacts a surface of cover member 51, and second surface 56*b* is exposed to form the point of contact between each link 50 and the wrist. In addition, second springbar 53*b* extends through channel 57*b* such that tube 58 contacts the interior surface of channel 57*b* and ends 59 extend outward from channel 57*b*.

Figure 9:
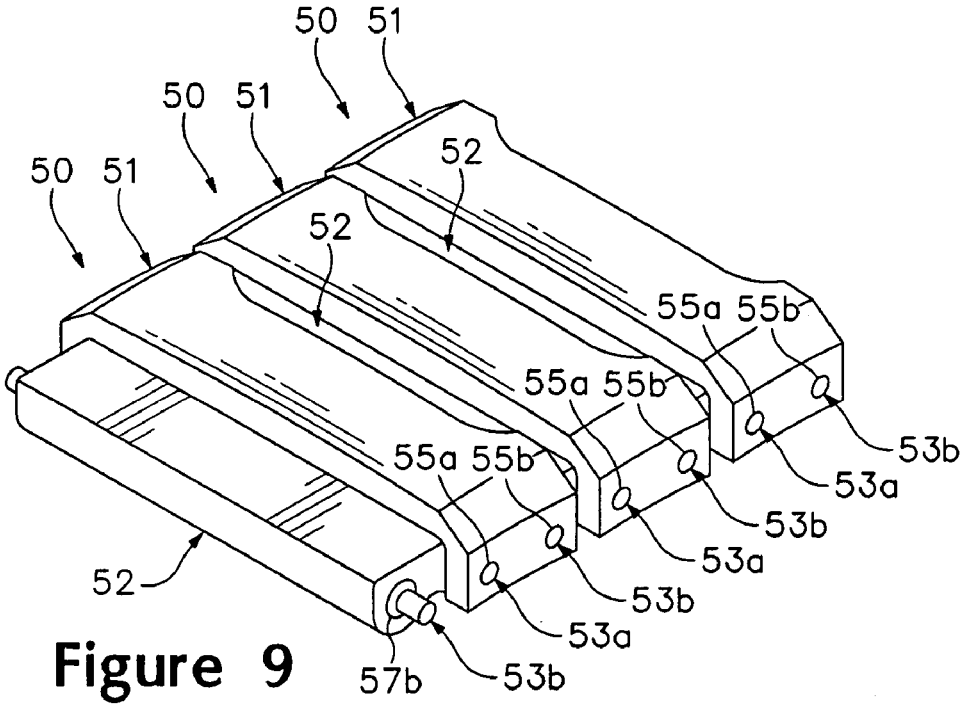
FIG. 9 is a perspective view of three joined link portions.
Figure 10:
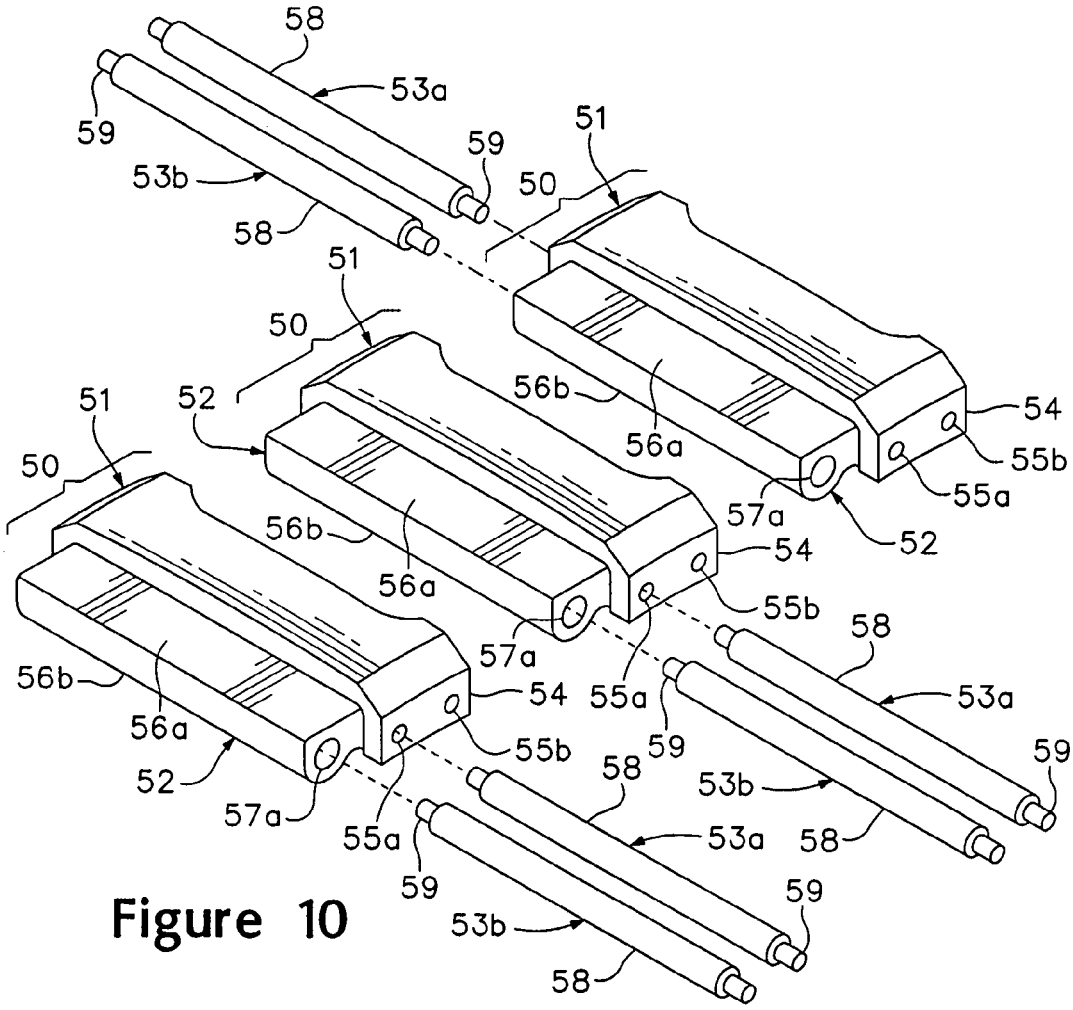
FIG. 10 is an exploded perspective view of the three link portions.

In the assembled configuration of link 50 discussed above, apertures 55*b* and second springbar 53*b* form connection points with adjacent links 50. With reference to FIGS. 9 and 10, link 50 is positioned between and joined to two additional links 50, which are numbered link 50' and link 50" for reference. Link 50' includes a cover member 51', an extension element 52', a first springbar 53*a*', and a second springbar 53*b*'. Cover member 51' includes a pair of end portions 54' that each define an aperture 55*a*' and an aperture 55*b*'. Similarly, link 50" includes a cover member 51", an extension element 52", a first springbar 53*a*", and a second springbar 53*b*". Cover member 51" includes a pair of end portions 54" that each define an aperture 55*a*" and an aperture 55*b*". Accordingly, link 50' and link 50" each exhibit a configuration that is substantially identical link 50.

As with link 50, a portion of extension element 52' extends outward from cover member 50'and second springbar 53*b*' extends through extension element 52'. In this position, the portion of extension element 52' that includes second springbar 53*b*' extends under cover member 51 such that second springbar 53*b*' extends into apertures 55*b* and secures link 50' to link 50. That is, second springbar 53*b*' and apertures 55*b* cooperatively operate to join links 50' and 50.

The portion of extension element 52 that includes channel 57*b* extends outward from cover member 51, as discussed above. In order to secure link 50 to link 50", the portion of extension element 52 that includes second springbar 53*b* extends under cover member 51" such that second springbar 53*b* extends into apertures 55*b*" and secures link 50 to link 50". In other words, second springbar 53*b* and apertures 55*b*" cooperatively operate to join links 50 and 50".

Numerous links 50 may be joined together in the general manner discussed above. That is, a second springbar 53*b* of one link 50 may extend into apertures 53*b* of an adjacent link 50 to join the two links together. Referring to FIG. 1, first band portion 41 and second band portion 42 are each formed from multiple links 50 that are joined in this manner. Although the structure of the various links 50 are substantially similar, variations in links 50 modify the shape of band 40 in different locations. For example, the links 50 that are proximal to case 20 have a greater width than the links 50 proximal to clasp 43. That is, first band portion 41 and second band portion 42 exhibit a tapered configuration through links 50 with decreasing width. In addition, the links 50 positioned adjacent clasp 43 may have a structure that differs from the specific structure discussed above in that clasp 43 may join directly with a cover member 51. That is, a variety of attachment mechanisms may be utilized for clasp 43.

In the above discussion relating to the structure of links 50, each link 50 included a separate, discrete extension element 52. An advantage of this configuration is that the overall flexibility of band 40 is increased through the independent movability or rotatability of each extension element 52. In some embodiments, however, various adjacent extension elements 52 may be joined together. For example, the extension elements 52 that are proximal to case 20 may be joined, whereas the extension elements 52 that are proximal to clasp 43 may be separate and discrete. This configuration increases the flexibility of the portions of band 40 that are adjacent clasp 43.

Figure 2:
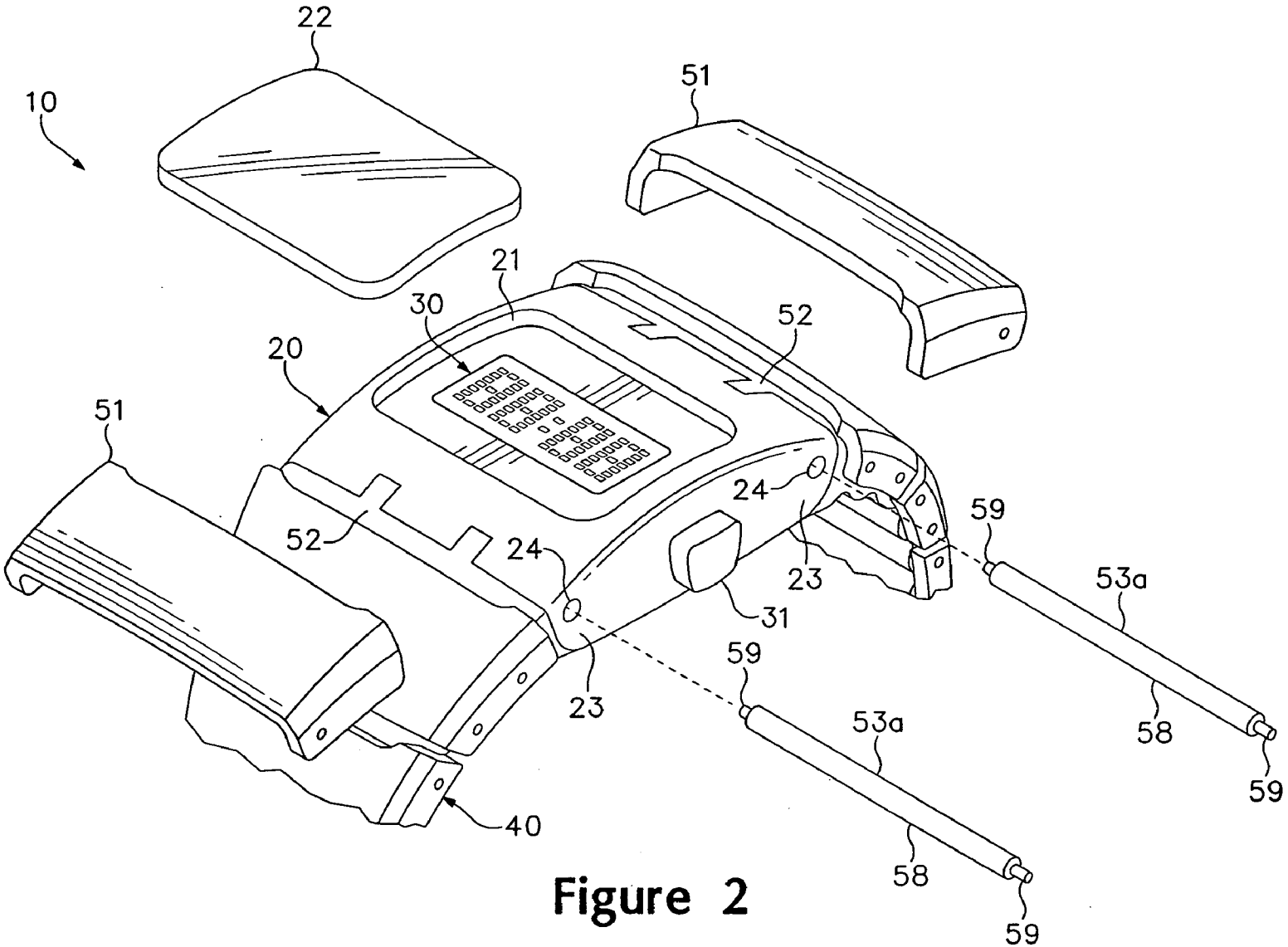
FIG. 2 is a partial exploded perspective view of the timepiece.
Figure 3:
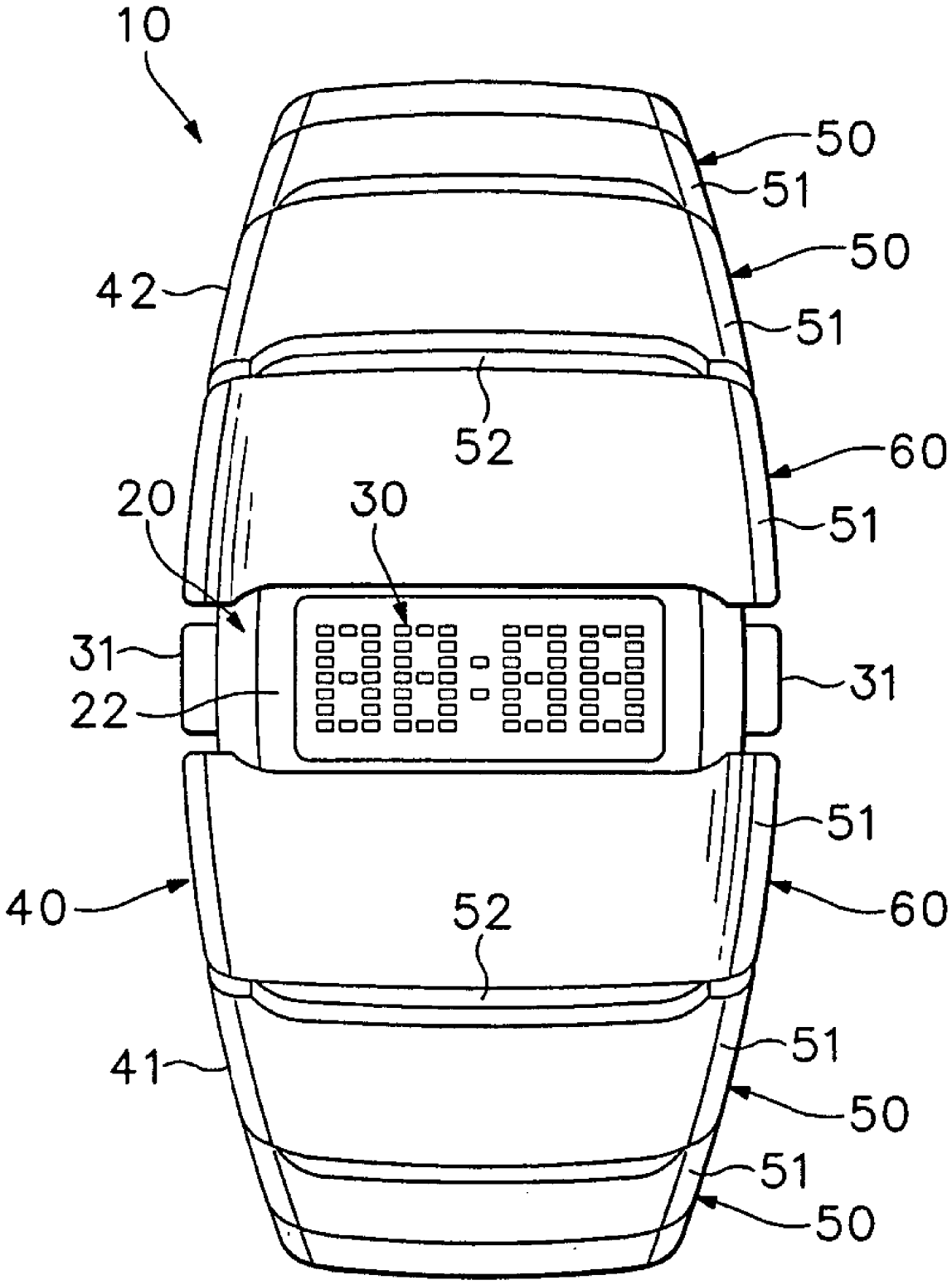
FIG. 3 is a top plan view of the timepiece.
Figure 4:
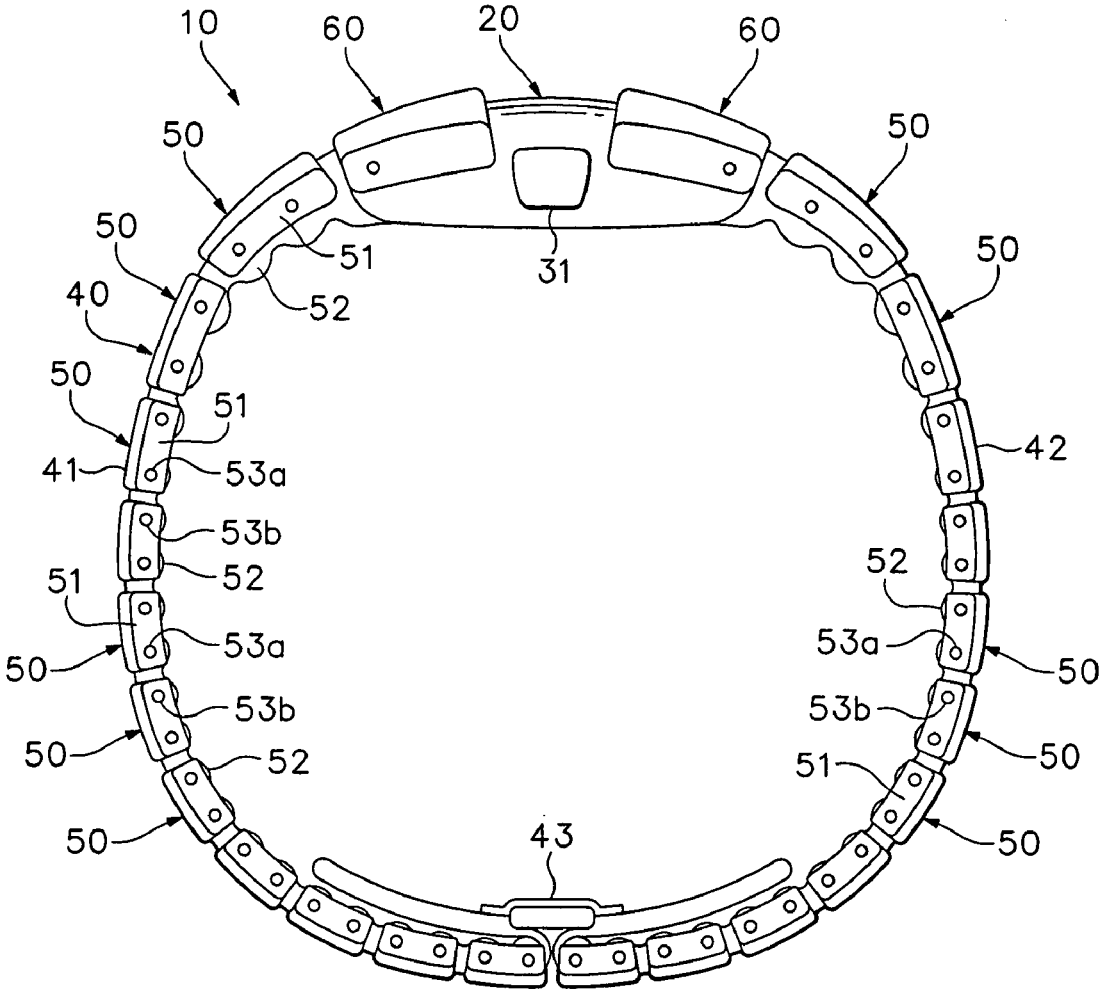
FIG. 4 is a side elevational view of the timepiece.

The manner in which first band portion 41 is secured to case 20 will now be discussed with reference to FIG. 2. Connector link 60 is depicted as having a configuration wherein an extension element 52 extends between projections 23 and a first springbar 53*a* extends through extension element 52 and into apertures 24 in order to join first band portion 41 to case 20. In addition, a cover member 51 extends over a portion of case 20, and particularly crystal 22, such that end portions 54 extend over projections 23. Ends 59 of the first springbar 53*a* protrude from apertures 24 and extend into apertures 55*a* of the cover member 51, thereby securing the cover member 51 to timepiece 10. A similar attachment system involving another connector link 60 may be utilized to join second band portion 42.

In many conventional timepieces, the crystal is exposed and may, therefore, be damaged through contact with another object. In timepiece 10, however, two cover members 51 extend over opposite sides of crystal 22 and provide crystal 22 with a degree of protection. That is, two cover members 51 are secured to the front and rear areas of case 20 to protect crystal 22.

Band 40 is disclosed above in the context of timepiece 10, particularly a watch. A band having the structure and features of band 40 may also be incorporated into a variety of other products, including jewelry, for example. Accordingly, band 40 may have application to a variety of different products, in addition to timepiece 10.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A wrist-worn timepiece comprising:

a case that defines a recess;

a taming element positioned within the recess;

a crystal extending over the timing element, the crystal being formed of an at least partially transparent material; and a band extending from at least one side of the case, the band having a plurality of links, and the band including a cover member with a configuration of a plate that extends over at least a portion of the crystal and extends across an entire width of the crystal said cover member covering at least a portion of said case.

2. The timepiece recited in claim 1, wherein a connector extends through a connector area of the case and joins the band to the vase, the connector including a pair of end portions that extend through apertures in the cover member to secure the cover member to the case.

3. The timepiece recited in claim 1, wherein the cover member and another cover member extend over the crystal.

4. The timepiece recited in claim 3, wherein the cover member and the another cover member are two separate elements that are secured to opposite sides of the case.

5. The timepiece recited in claim 1, wherein the cover member and another cover member extend over opposite sides of the crystal, a display of the timing element being entirely visible between the cover member and the another cover member.

6. The timepiece recited in claim 1, wherein the links include an end link that joins with the case to secure the band to the case, the cover member extending over a portion of the end link.

7. The timepiece recited in claim 6, wherein a connector extends through a connector area of the case and joins the end link to the case, and the connector includes a pair of end portions that extend through apertures in the cover member to secure the cover member to the case.

8. A wrist-worn timepiece comprising:

a case that defines a recess;

a timing element positioned within the recess, the timing element having a visible display;

a crystal extending over the timing element, the crystal being formed of an at least partially transparent material; and a band extending from at least one side of the case, the band having a pair of cover members that extend over edges of the crystal and across an entire width of the crystal to define a space between the pair of cover members, said cover members covering at least a portion of said case an entirety of the display of the timing element being visible through the space.

9. The timepiece recited in claim 8, wherein a connector extends through a connector area of the case and joins the band to the case, and the connector includes a pair of end portions that extend through apertures in one of the pair of the cover members to secure the one of the pair of the cover members to the case.

10. The timepiece recited in claim 8, wherein the pair of cover members are two separate elements that are secured to opposite sides of the case.

11. The timepiece recited in claim 8, wherein the band is formed from a plurality of links, the band including an end link that joins with the case to secure the band to the case, one of the pair of cover members extending over at least a portion of the end link.

12. The timepiece recited in claim 11, wherein a connector extends through a connector area of the case and joins the end link to the case, and the connector includes a pair of end portions that extend through apertures in the one of the pair of cover members to secure the one of the pair of cover members to the case.

13. A wrist-worn timepiece comprising:

a case that defines a recess;

a timing element positioned within the recess, the timing element having a visible display;

a crystal extending over the timing element, the crystal being formed of an at least partially transparent material; and a band defining a pair of end areas that join with opposite sides of the case to secure the band to the case, the band having a pair of cover members with the configuration of plates that extend over edges of the crystal to define a space between the pair of the cover members, the cover members extending across an entire width of the crystal, the time display being visible through the space, said cover members covering at least a portion of said case.

14. The timepiece recited in claim 13, wherein connectors extend through the end areas to join the band to the case, the connectors each including a pair of end portions that extend through apertures in the pair of the cover members to secure the pair of the cover members to the case.

15. The timepiece recited in claim 14, wherein the connectors are springbars.

16. The timepiece recited in claim 13, wherein the display is entirely visible through the space between the cover members.

17. The timepiece recited in claim 13, wherein the cover members each have a central portion and a pair of connecting portions, the central portion extending over the crystal, and the connecting portions extending downward from the central portion to join with the case.

18. The timepiece recited in claim 13, wherein the crystal is formed from a polymer material.

* * * * *